United States Patent [19]

Brüderle et al.

[11] 4,432,672

[45] Feb. 21, 1984

[54] CANAL BUILDING APPARATUS

[75] Inventors: Egon U. Brüderle, Zweibrücken; Willibald Wannemacher, Bierbach, both of Fed. Rep. of Germany

[73] Assignee: Mannesmann Demag AG, Duisburg, Fed. Rep. of Germany

[21] Appl. No.: 323,713

[22] Filed: Nov. 23, 1981

Related U.S. Application Data

[63] Continuation of Ser. No. 71,845, Sep. 4, 1979, abandoned.

[30] Foreign Application Priority Data

Sep. 20, 1978 [DE] Fed. Rep. of Germany ..... 2840800

[51] Int. Cl.[3] ..... E02F 5/04

[52] U.S. Cl. ..... 405/268; 37/80 A; 37/DIG. 16; 405/303

[58] Field of Search ..... 405/268, 270, 303, 174–183; 37/110, 108 R, 108 A, 80 A, 40 L, 80 R, 85, DIG. 3, DIG. 16

[56] References Cited

U.S. PATENT DOCUMENTS

| | | | |
|---|---|---|---|
| 929,732 | 8/1909 | Buren et al. | 37/80 A |
| 3,328,902 | 7/1967 | Hanson . | |
| 3,452,461 | 7/1969 | Hanson | 37/110 |
| 3,778,168 | 12/1973 | Willner | 37/80 R X |
| 3,813,171 | 5/1974 | Teach et al. | 37/80 R X |
| 3,922,802 | 12/1975 | James | 37/DIG. 16 |

FOREIGN PATENT DOCUMENTS

| | | | |
|---|---|---|---|
| 1484607 | 11/1969 | Fed. Rep. of Germany | 37/80 A |
| 377490 | 6/1973 | U.S.S.R. | 37/80 A |

*Primary Examiner*—Dennis L. Taylor

*Attorney, Agent, or Firm*—Mandeville and Schweitzer

[57] ABSTRACT

An apparatus is disclosed for the continuous longitudinal construction for canals. The apparatus performs a series of sequential operations required for the construction of a canal. The apparatus performs planing of the surfaces of the sidewall slopes of the canal and the canal bed followed by a smooth surfacing of the planed surfaces with a suitable planing material.

The apparatus during the canal construction adjusts to the angle defined by the opposed sloped walls of the canal and is adapted so that the ground-engaging carriages are held against the sloped walls. In this manner, the heavy bridging structures which, in the prior art, extend from one berm of the canal, across the canal, and to the other berm, are eliminated. In addition, two or more apparatus frames are pivotally connected one behind the other. In this manner, continuous adjusting at the connecting hinge is performed as the canal is constructed according to the varying parameters of the canal.

4 Claims, 4 Drawing Figures

CANAL BUILDING APPARATUS

This is a continuation of application Ser. No. 71,845, filed Sept. 4, 1979, now abandoned.

The invention relates to canal building apparatus for continuous operation in the longitudinal direction of the canal, with tools attached to the apparatus frame for the treatment or development of the canal cross section both parallel and transverse to the longitudinal direction of the canal. Adjustable carriages are provided for supporting the apparatus frame for conveying the apparatus for operating purposes and for self-transport, respectively.

This kind of canal building apparatus serves in the construction of irrigation ditches, power station canals, and inland waterways, as well as roadways or track right-of-ways with banked bends. After ground excavation work by excavators and planing caterpillars, a canal profile exists with uneven boundary lines and tolerances greater than 20 cm. In this construction phase, the canal building apparatus is utilized to plane the canal profile by scaling off and leveling the uneven ground surface using a planing apparatus. To the leveled ground thus formed, a lining of concrete, asphalt concrete, clay, Hydra-clay bitumen, or the like is applied. The lining is installed by means of special installing machinery. Depending upon the kind of lining material used, the lining apparatus is selected according to that material. Depending upon the contour or profile of the canal cross section, either total cross section machinery or slope or bank machinery is utilized. Slope machinery may apply a layer to either the slope section only, or the slope together with a portion of the canal bed.

Canal building apparatus has been disclosed in the past which performs either at different times, or as separate units, the planing work and the lining work in a continuous or a discontinuous operation. In contrast with this separate operation, the present invention provides canal building apparatus facilitating simultaneous combined planing and lining. The treatment of the canal profile is continuous.

Planing is done by means of a series of circulatory palettes which scale off in a movement transverse to the longitudinal canal direction. The lining materials are also applied in a transverse direction in order to distribute the lining materials (concrete, bitumen, and the like) over the width of the canal profile. Any further work, such as solidification, if necessary, plastification of concrete materials, pounding and finishing or smoothing again takes place in the longitudinal canal direction. If required, fitting or molding of longitudinal and cross joints junctures may take place during the same operation.

Furthermore, it is known to provide canal building apparatus for continuous operation in the longitudinal canal direction with a frame for the apparatus. The frame is equipped to move the entire apparatus for operating purposes, and also for self-transport, by means of adjustable carriages. Such known canal building apparatus for treating a total canal profile, has carriages which, in operating position, support themselves by means of caterpillar carriages on the canal berms. The support distance of the carriages is determined by the canal width. A lowering of the apparatus frame between the carriages to the intended distance from the canal bed is achieved by means of a complicated system of cantilevered supports, and their adjusting mechanisms. The cantilevered supports and the adjusting mechanisms, respectively, further allow for engaging the carriages to raise the entire remaining apparatus structure in order to move it along the canal on level ground without external means of transportation.

The disadvantage of this known canal building apparatus is the involved adjusting machinery, and the heavy weight, in total profile apparatus. However, even in partial canal profile building apparatus, the frames consist essentially of bridge-shaped support structures of at least the support width of the breadth of the canal, measured from berm to berm, and the partial profile apparatus itself is of a slope length. Such bridge-shaped support structures require, due to the great bending moments occurring in the center, a considerable expenditure of materials, and increase in the total weight of the material of the supporting parts. The higher weight of the canal building apparatus impairs mobility, and affects the gear requirements of the carriage being equipped with a continuous speed regulator, as well as the electronic and hydraulically controlled leveling, steering and synchronizing automatic equipment.

The present invention provides canal building apparatus which is simpler and lighter, thus improving the adaptability of this type of apparatus in view of the different kinds of operations required as well as economic use. This is achieved by providing that each carriage consisting of tire wheels and caterpillars, is, in operating position, supported against the opposed canal slopes at an angle, and that the carriages are each hinged, individually, transversely of the work area, on the apparatus frame. The new basic conception eliminates bridge girders of the previously known type. This advantage is achieved by no longer supporting the carriages on the berms, as heretofore, but rather on the planed slopes. The displacement of the carriages to the interior of the cross sectional profile of the canal under construction affords a support of the apparatus frame within the canal, independent of the berms. Another advantage is the rotatable carriages, whose field of rotation may be used in a two-fold manner. On one hand, the rotation can be used when going through bends to adjust the tools in relation to one another. On the other hand, carriages rotated into the vertical line serve to self-transport the canal building apparatus on level ground within the construction site.

The canal building apparatus of this invention, furthermore, is more easily and simply handled, and constitutes a considerable improvement relative to the construction of the steering and leveling mechanisms. The support of the carriages on the slopes has the further advantage of providing a central arrangement with sufficient room for the Diesel drive and control panel without subjecting the apparatus frame to the previously known stresses. Finally, a further advantage of the invention is that the carriage support is independent of the distance between the berms, as well as their load-carrying capacity and breadth. The tire wheels rolling along the slope surfaces vertically cause, due to their slanted position vs. the vertical line, an increased traction analogous to a wedge effect, so that despite the reduced weight of the apparatus, the tractability remains. The total of these advantages contribute to a simplified, construction of canal building apparatus.

It is also of advantage that rockers for the tire wheels and the caterpillars, respectively, are attached flexibly on both sides of an apparatus frame portion extending, in operating position, in the longitudinal canal direction in the center and bed area of the trapezoidal canal cross section. The carriages, hinged in this manner, utilize the space present within the canal cross section. The canal building apparatus according to the invention may be used on canals having cross sections of between two and 80 square meters, for example.

The compact design of the apparatus frame and carriages can be further condensed by arranging the hydraulic gears for the pivotal motion between the apparatus frame part, which is in the center and bed area, respectively, of the canal cross section in operating position, and the rockers. Also, the invention provides for complete elimination of the known bridge girders by providing the apparatus frame with cantilevered beams for the attachment of the working tools, extending parallel with the canal slopes and being connected to that portion of the frame which, in operating position, is found in the center and bed area, respectively, of the canal cross section.

The apparatus of the invention can be used for a combination of planing and lining apparatus heretofore provided as separate units. The invention provides that for two or several machines, succeeding one another in the direction of the course, accommodating different working tools whose operations are in sequence, two apparatus frames each are hinged, and that the joint angle may be continuously adjusted, depending on the guiding system sensing the course of the canal.

In addition, provision is made that next to the joint connection, between two combined machines providing different operations, length-adjustable control elements are installed in pairs, symmetrically with the connecting joint, and each hinged to the two machines. Such a connection with the steering mechanism has the advantage, together with the four-wheel rocker carriage, that the steering connection forms the center of the entire structure, allowing relatively simple adjustment of the sides of the connected machines during bends.

The length-adjustable control elements consist of hydraulic piston-cylinder units. This control mechanism is based on simple steering kinematics whose functions may be maintained very easily in a straight, as well as in a curved, canal line. They are determined by such unequivocally defined geometrical dependences that the profile lines of two or more connected machines arranged in succession, and connected in accordance with the invention, may be brought into proper alignment with each other.

The control of the canal building apparatus, according to the invention, is done by providing measuring instruments for the angle deviations of two successive machines from the predetermined desired curvature, for deviations from the track center, and from the vertical position of the central apparatus frame. The corrective values are transmittable by nominal and set value indicators, respectively, to the piston-cylinder units on the carriages.

An example of the invention is illustrated in the drawings, and explained in detail as follows.

DETAILED DESCRIPTION OF THE DRAWINGS

Figure 1:
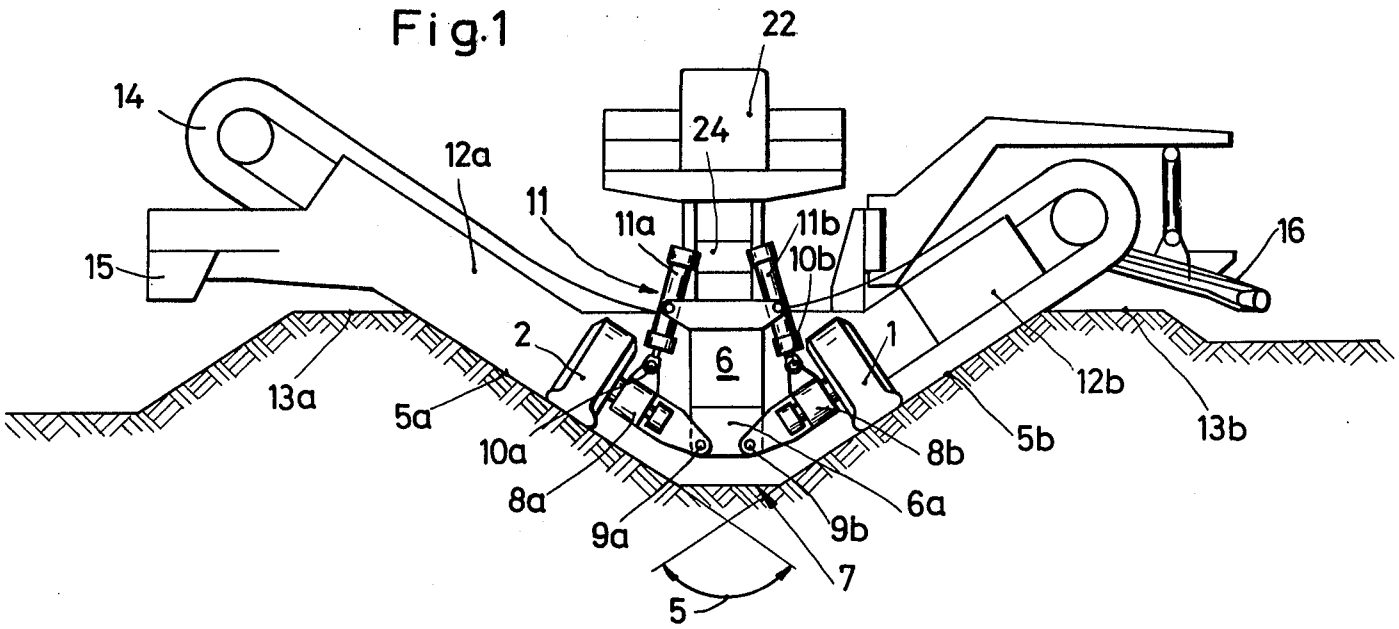
FIG. 1 illustrates canal building apparatus according to the invention and is a sectional view transverse of the canal axis taken along lines I—I of FIG. 4.
Figure 3:
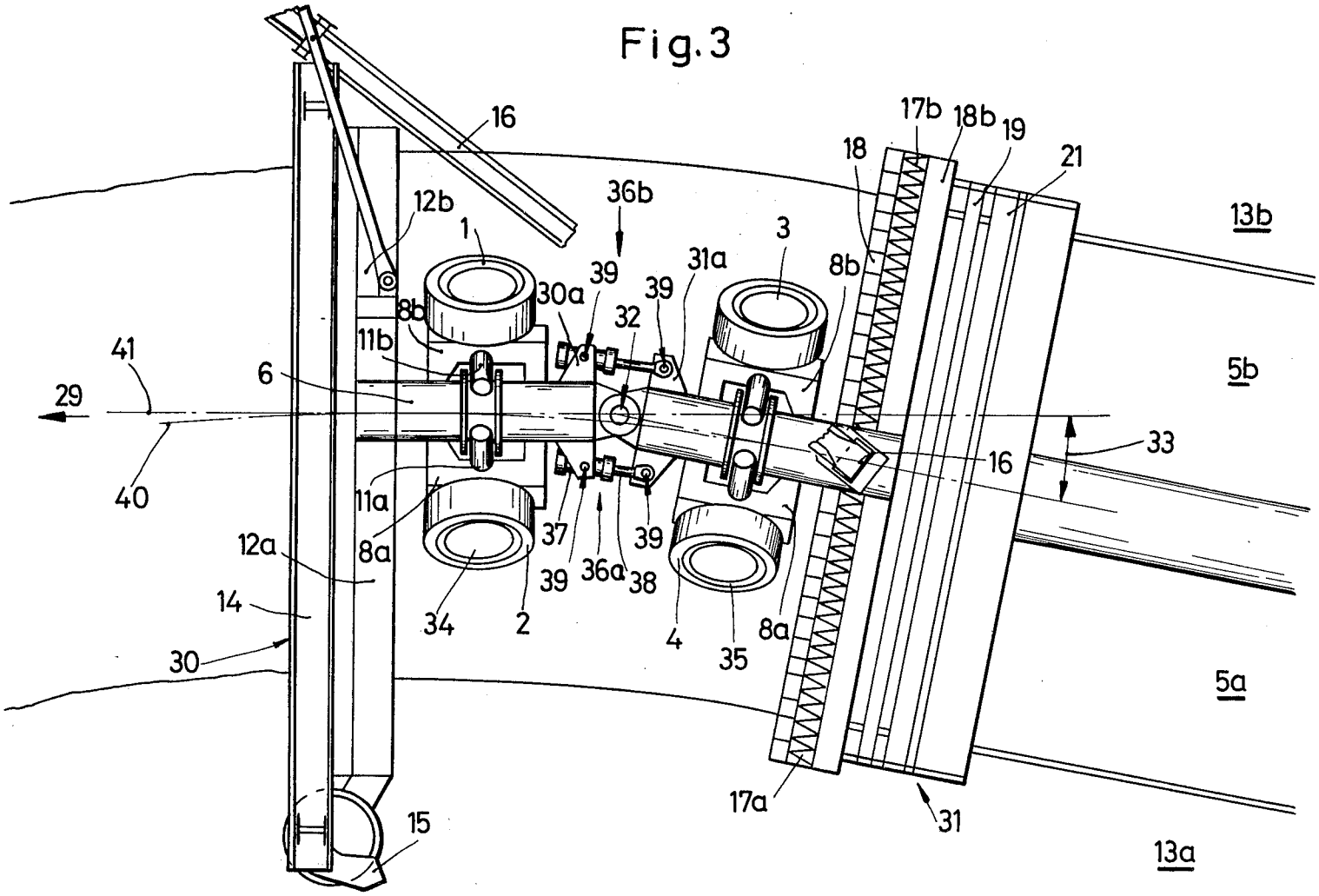
FIG. 3 is a longitudinal horizontal sectional view of the apparatus of FIG. 4 taken along lines III—III, and illustrating the apparatus frame for a combination of two machines of different type with the carriages in a position for negotiating a curve.

The illustrated apparatus shows a combination of a planing apparatus with a lining apparatus. One apparatus, as well as the other, can each be combined with other types of apparatus of canal building machinery. Furthermore, it is possible with this invention to combine more than two types of apparatus. The canal building apparatus has one or more pairs of carriages. The carriages consist of tire wheels 1, 2 and 3, 4, respectively, (FIGS. 1 and 3). These support themselves on the slopes 5*a*, 5*b* of the approximately trapezoidal canal cross section, being positioned at an angle 5. It is to be assumed according to a predetermined plan that the slope angle will remain constant during the course of the canal line. However, the invention is also suitable for a slope angle 5 changing steadily, or in a stepped manner. The canal building apparatus is also supported by two pairs of carriages in its illustrated arrangement as independent planing or lining apparatus. The apparatus frame 6 extends in the longitudinal direction of the canal course and is provided with a frame portion 6*a* (FIG. 1) extending toward the center and bed 7, to which the rocker 8*a*, 8*b* are flexibly hinged.

The joints 9*a*, 9*b* are of the type that the rockers may be moved in the plane of the drawing and to a small extent, if necessary, perpendicular to the plane of the drawing. Piston rods 10*a*, 10*b* and hydraulic piston-cylinder gears 11 are hinged to the rockers 8*a*, 8*b* with cylinders 11*a*, 11*b* hinged at apparatus frame 6. The apparatus frame comprises cantilevered beams 12*a*, 12*b* supported on frame 6*a*. Such cantilever beams extend also from the bridge girder attached on the frame portion 6*a*, and thus supported in the center. However, they are to be regarded as cantilever beams due to the type of stress they are under. Therefore, they are of lighter dimensions than the conventional bridge girders bridging the canal cross section from berm to berm.

The cantilevered beams 12*a*, 12*b* overhang the berms 13*a* and 13*b*, respectively. They carry, if the apparatus is a planing apparatus as shown, bucket chains and bucket conveyors 14, which are guided on the cantilevered beams 12*a*, 12*b* and the frame portion 6*a* respectively. A canal building apparatus equipped in this manner can perform the entire excavation of the canal profile as well. The excavated material is dropped by means of a chute 15. For any changes in the width of the canal in the course of the canal line, telescopic extensions (not illustrated) may be installed extending the length of the cantilever beams 12*a*, 12*b*. The cantilever beams may also be extended by attaching individual extending sections joined to one another.

If developed as lining apparatus, also called installing apparatus (FIG. 2) the working tools consist of mechanisms to feed, distribute and solidify the lining material, which may be concrete. Supplemental mechanisms may be included for installing and fitting longitudinal and cross joints.

Figure 2:
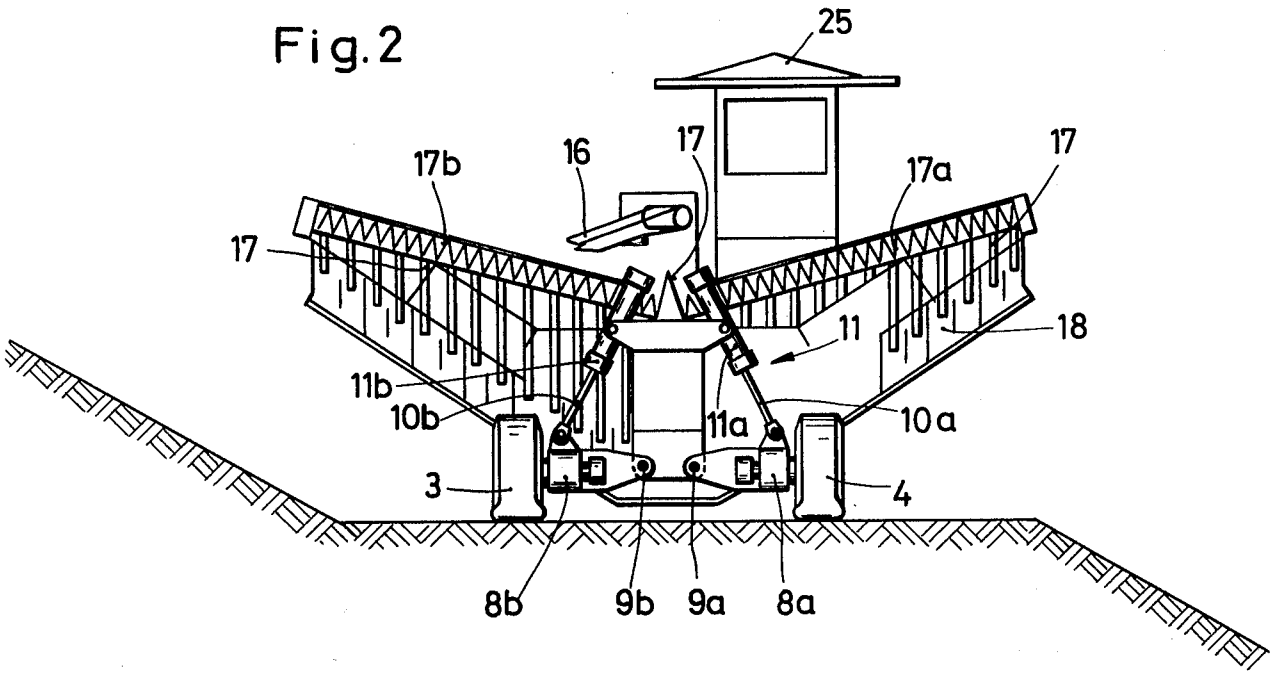
FIG. 2 is a cross-sectional view taken along lines II—II of FIG. 4, and illustrating the apparatus in a transporting position.
Figure 4:
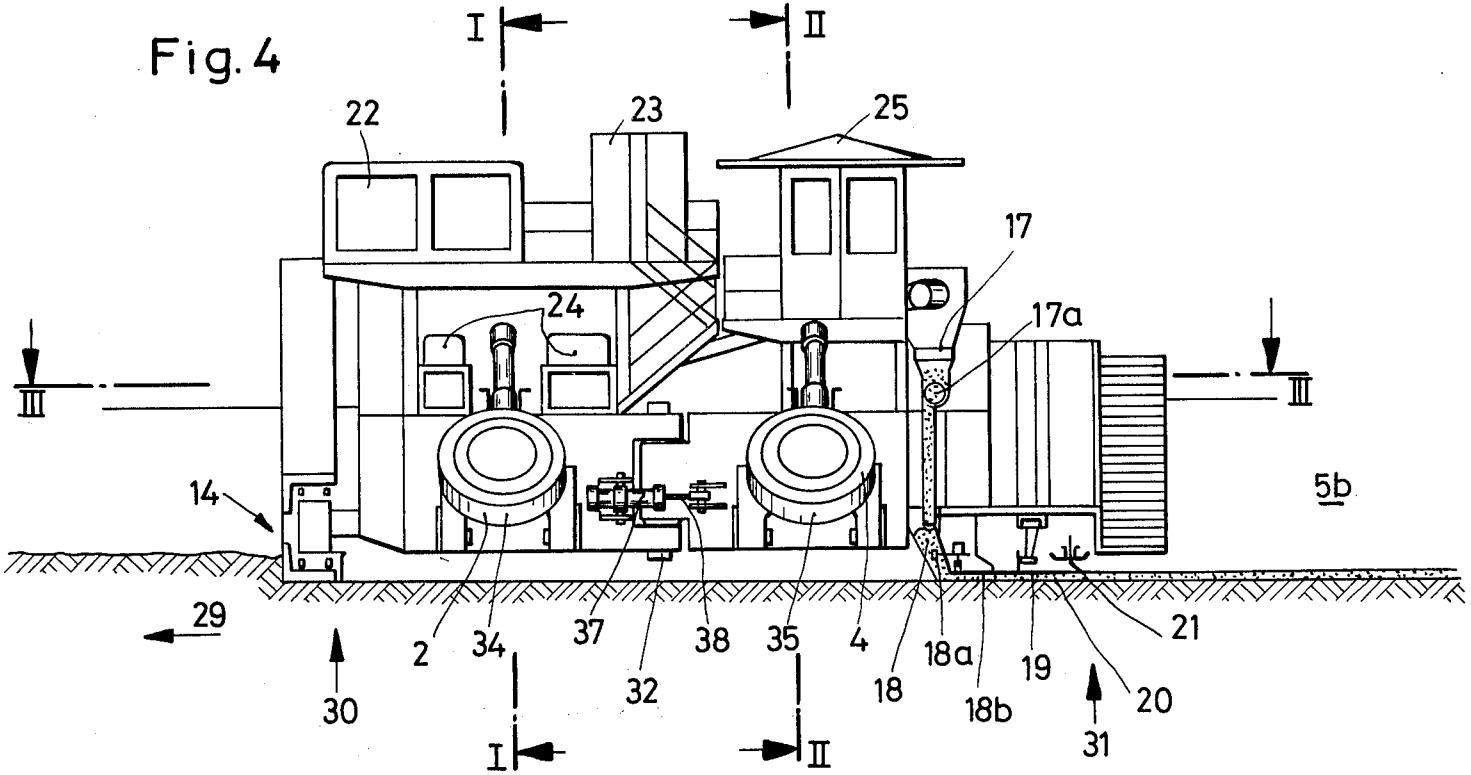
FIG. 4 is a side elevational view illustrating a combination of two canal building machines of different types according to FIG. 3.

The illustrated embodiments of the invention shown in FIGS. 2, 3, and 4 are provided with, for example, conveyor belt 16, for feeding; screw conveyors 17*a* and 17*b* (FIG. 2) with delivery chutes 17 (FIG. 4), for distribution; inner vibrators 18*a* in settling vibration chambers 18, and a succeeding screen 18*b*, for compacting solidification; smoothing plank 19 reciprocating transverse to the canal axis, to finish the surface. Also included are self-aligning moldings 20 installed in ski-like manner, to fit the longitudinal joints, and cutting moldings 21 which act like blades, to provide for fitting in the cross joints.

The canal building apparatus according to FIG. 2 shows the tire wheels 3 and 4 rotated into the position for moving the apparatus. In this position, the apparatus travels on level ground within the construction site between required locations. By tilting the rockers 8*a* and 8*b* upwards in the position shown in FIG. 1, the parallel position of the working tools attached to the apparatus frame in relation to the slopes 5*a* and 5*b* is achieved.

The invention makes it possible to combine tasks which were previously performed by two or more canal building machines of different types. According to FIG. 3, a planing apparatus 30 and a lining apparatus 31 are arranged in succession in the direction of the course 29. A joint connection 32 is provided at the apparatus frame 6. The joint angle 33 is scanned according to a guide wire, laser beam, or the like marking the course of the line next to the berm 13*a*, 13*b*, at the level of wheel axles 34 and 35, and is transmitted to the length-adjustable control elements 36*a* and 36*b* developed as piston-cylinder units in pairs. The two cylinder housings 37 on one hand and the two piston rods 38 on the other hand form pivot joints 39 on the steering frame 30*a* and 31*a* extending and protruding as far as possible into the width of the vehicle from the center of the vehicle. The legs of the joint angle 33 each form tangents, deviating only slightly, at the center of curvature 40 at the track center 41, matching the center of the canal and/or the center of the apparatus.

The aggregate structure found above the frame portion 6, such as, for example, a hydraulic drive 24 for driving wheels 1 through 4 (FIG. 4), a Diesel current generator 22, and an electrical distributor station 23 with corresponding connections, are not shown in FIG. 3 in order to free the view of the tire wheels 1 through 4 from above.

In the area of wheel axle 34 planing apparatus is shown, while in the area of wheel axle 35 a lining apparatus is shown. Thus, the planing apparatus is positioned at the level of the wheel axle 34, and the lining apparatus at the level of the wheel axle 35.

FIG. 4 shows the cross section of planing and lining apparatus 30, 31 respectively, following in succession as shown in FIG. 3. The entire structure, as well as the flow of material chosen for the continuous operation, and also the functional connection of the various working tools between each other can be seen here. At the same time, FIG. 4 shows that by combining the planing and lining work in the combined apparatus, desired requirements in quality and accuracy can be better met, as unfavorable influences, such as drying out, erosion, separate guiding of apparatus normally present when there are chronological and spatial intervals, are eliminated. Due to the central control stand 25, arranged in unobstructed location, further simplifications in attending the apparatus with corresponding reduction of personnel can be achieved reducing the intrinsic weight. The relatively significant load weights of Diesel current generator 22, electrical distributor station 23, as well as hydraulic gear and control drive 24 may be centrally located directly above the carriages.

The invention also makes it possible to reduce the required total weight for the complete canal building apparatus equipment considerably, to have the combined canal building apparatus unite more operating procedures than heretofore and under more economical conditions, and to have the canal building apparatus, according to the teaching of the invention, combine simplified construction with an efficient mode of operation.

We claim:

1. An apparatus for the continuous longitudinal construction of a canal having a canal construction mode of operation and a transporting mode of operation capable of moving the apparatus from one working site to another, comprising:

(a) an apparatus frame;

(b) a pair of opposed wheel support arms pivotally attached to said apparatus frame;

(c) a wheel rotatably attached to each of said wheel support arms;

(d) said wheels, wheel support arms and apparatus frame being capable of achieving a configuration during the canal construction mode of operation, such that said wheels travel flush on the sloped walls of a canal and the center of gravity of said wheels, wheel supporting arms and apparatus frame lie below the berm of the canal;

(e) canal construction tool means transversely supported, in a cantilevered manner, on said apparatus frame;

(f) said canal construction tool means extending upwardly from said apparatus during the canal construction mode of operation and beyond said wheels; and (g) adjustable maintaining means, attached between said apparatus frame and said wheel support arms for selectively determining the angular orientation of said wheel support arms with respect to said apparatus frame such that said wheels and wheel support arms, during the canal construction mode of operation, extend upwardly from said apparatus frame and said apparatus frame lies between said wheels and within the canal being constructed.

2. A canal construction apparatus as claimed in claim 1, wherein:

(a) said adjustable maintaining means is capable of continuously adjusting, during a canal construction mode of operation, to accommodate changing canal parameters.

3. A canal construction apparatus, comprising at least two of the canal construction apparatus as claimed in claim 1, wherein:

(a) the apparatus frames are arranged one behind another and are hinged together about central pivot points, the leading apparatus frames located ahead of the following apparatus frames;

(b) the canal construction tool means of each apparatus frame being configured to accomplish a different yet simultaneously working canal construction function, the canal construction tool means of the following apparatus frames being adapted to accomplish a sequentially related function with respect to the function to be accomplished by the canal construction tool means of the leading apparatus frames; and (c) adjustable steering means for continuously maintaining a predetermined yet selectively alterable angle between the leading and following apparatus frames.

4. A canal construction apparatus as claimed in claim 3, wherein said adjustable steering means comprises:

(a) a pair of generally horizontally extending length adjustable power means having a first and second end;

(b) one of said pair of power means being mounted on each side of said central pivot point; and (c) the first end of said power means being connected to said leading apparatus frames with the second end of said power means being connected to said following apparatus frames.

* * * * *